US010961726B2

(12) United States Patent
Baum

(10) Patent No.: US 10,961,726 B2
(45) Date of Patent: Mar. 30, 2021

(54) SELF-LIFTING CONCRETE FORM ADAPTED TO ACCOMMODATE HORIZONTAL REINFORCING STEEL

(71) Applicant: Norton Baum, Inverness, IL (US)

(72) Inventor: Norton Baum, Inverness, IL (US)

(73) Assignee: Forming Concepts, Inc., Gilberts, IL (US)

( * ) Notice: Subject to any disclaimer, the term of this patent is extended or adjusted under 35 U.S.C. 154(b) by 533 days.

(21) Appl. No.: 15/467,770

(22) Filed: Mar. 23, 2017

(65) Prior Publication Data

US 2017/0254100 A1 Sep. 7, 2017

Related U.S. Application Data

(62) Division of application No. 13/916,311, filed on Jun. 12, 2013, now Pat. No. 9,611,663.
(Continued)

(51) Int. Cl.
*E04G 11/20* (2006.01)
*E04G 11/02* (2006.01)
(Continued)

(52) U.S. Cl.
CPC ..... *E04G 11/20* (2013.01); *E04G 11/02* (2013.01); *E04G 11/22* (2013.01); *E04G 11/24* (2013.01); *E04G 11/28* (2013.01)

(58) Field of Classification Search
CPC ..... E04G 11/30; E04G 11/28
See application file for complete search history.

(56) References Cited

U.S. PATENT DOCUMENTS 1,478,653 A * 12/1923 Holmes ..... E04G 11/30 249/191
3,779,678 A 12/1973 Scheller
(Continued)

FOREIGN PATENT DOCUMENTS

DE 2756390 A1 6/1979
FR 2239130 A5 * 2/1975

*Primary Examiner* — Galen H Hauth
(74) *Attorney, Agent, or Firm* — Erickson Law Group, PC

(57) ABSTRACT

A forming system includes a frame and two forming walls. The two forming walls are positioned at a distance from each other to define a first vertical wall course. One forming wall is supported by the frame such that the one forming wall can be translated toward or away from the respective other forming wall. The frame can be raised to raise the two forming walls to be positioned to pour a second vertical course on top of the first vertical course. The translation of the one forming wall allows for the pouring of the first vertical course with horizontally extending rebar that extends through the one forming wall outside of the first vertical wall course, to tie in to a subsequently poured floor slab. The translation permits the vertical raising of the one forming wall, without striking the extending rebar, to pour the second vertical course on the first vertical course. A worker's platform is provided that is supported by the frame and vertically movable by raising the frame. The worker's platform is located below the one forming wall on a side of the one forming wall opposite the respective other forming wall and is retractable to also clear the extending rebar during raising of the frame.

13 Claims, 6 Drawing Sheets

Related U.S. Application Data

(60) Provisional application No. 61/659,338, filed on Jun. 13, 2012, provisional application No. 61/713,334, filed on Oct. 12, 2012.

(51) Int. Cl.
*E04G 11/22* (2006.01)
*E04G 11/24* (2006.01)
*E04G 11/28* (2006.01)

(56) References Cited

U.S. PATENT DOCUMENTS

| | | | | |
|---|---|---|---|---|
| 3,973,885 | A | 8/1976 | Schmidt | |
| 4,016,228 | A | 4/1977 | Schmidt | |
| 4,040,774 | A | 8/1977 | Scheller | |
| 4,917,346 | A | 4/1990 | Mathis | |
| 5,198,235 | A | 3/1993 | Reichstein et al. | |
| 5,688,428 | A * | 11/1997 | Maguire | E04G 21/185 249/219.1 |
| 6,260,311 | B1 | 7/2001 | Vladikovic | |
| 6,276,912 | B1 | 8/2001 | Rock | |
| 6,557,817 | B2 | 5/2003 | Waldschmitt et al. | |
| 8,020,271 | B2 | 9/2011 | Baum et al. | |
| 9,611,663 | B2 | 4/2017 | Baum | |

* cited by examiner

SELF-LIFTING CONCRETE FORM ADAPTED TO ACCOMMODATE HORIZONTAL REINFORCING STEEL

This application is a divisional application of U.S. Ser. No. 13/916,311, filed Jun. 12, 2013 which claims the benefit of U.S. Provisional Application No. 61/659,338, filed Jun. 13, 2012 and U.S. Provisional Application No. 61/713,334, filed Oct. 12, 2012.

BACKGROUND OF THE INVENTION

When a concrete floor slab intersects a vertical concrete wall in most cases reinforcing steel will stick out of the vertical wall. This steel will later be poured into the intersecting concrete slab. This is done to ensure a good joint and no movement between the vertical wall and the concrete floor. However, this reinforcing steel creates an obstruction to direct vertical movement of the concrete formwork for the next course of the vertical wall.

Previously, either the floor and the wall were poured together, forcing the progress of the vertical walls to be dependent on the progress of the floor slabs, or an expensive reinforcing dowel bar substitute would be placed in the area where the reinforcing was to intersect the concrete slab. These methods are labor intensive and the dowel bar substitute itself is expensive.

The present inventor has recognized that the formwork for the vertical wall must allow for the penetration of the reinforcing steel and be able to be moved back quickly and easily for multiple reuses. The form must clear the protruding reinforcing steel.

The present inventor has recognized that scaffolding that is part of the self-rising system must allow for the protruding reinforcing steel to pass as the concrete form is lifted.

The present inventor has recognized that scaffold access must still be maintained in order to work on the form during the construction sequence.

The present inventor has recognized that a need exists to allow the reinforcing steel to be poured with the vertical concrete wall but still allow the concrete form to be easily stripped and lifted with the current self-lifting forms systems in the market place.

SUMMARY

The exemplary embodiment apparatus of the invention includes two forming walls that are positioned at a distance from each other to define a thickness of a vertical structure, such as a wall, to be filled or poured with concrete. At least one of the walls is supported by a frame such that the wall can be translated toward or away from the respective other wall. The apparatus can include a frame wherein the two forming walls are hung from the frame and one of the walls is hung with a rolling connection to be translated toward or away from the respective other wall. The frame can be provided with motive means for raising the forming walls to pour a course or level on top of a previously poured concrete course. The apparatus allows for the pouring of a course having horizontally extending rebar to tie in a floor slab to that course and for the vertical raising of the apparatus to pour a next course on the previously poured course without interference of the apparatus with the extending rebar. To this end, one of the walls that is adjacent to the extending rebar is movable horizontally away from the respective other wall by a distance sufficient to clear the extending rebar.

A workers platform is retractable or foldable to also clear the extending rebar. A forming strip is positioned onto the moving wall to form around the extending rebar and forms part of the forming surface of the movable wall.

When the movable wall is moved away from the respective other wall after the poured concrete between the walls has sufficiently set or cured, the forming strip detaches from the movable wall and is thereafter stripped off of the cured concrete wall and from around the extending rebar.

Numerous other advantages and features of the present invention will become readily apparent from the following detailed description of the invention and the embodiments thereof, and from the accompanying drawings.

DETAILED DESCRIPTION

Figure 1:
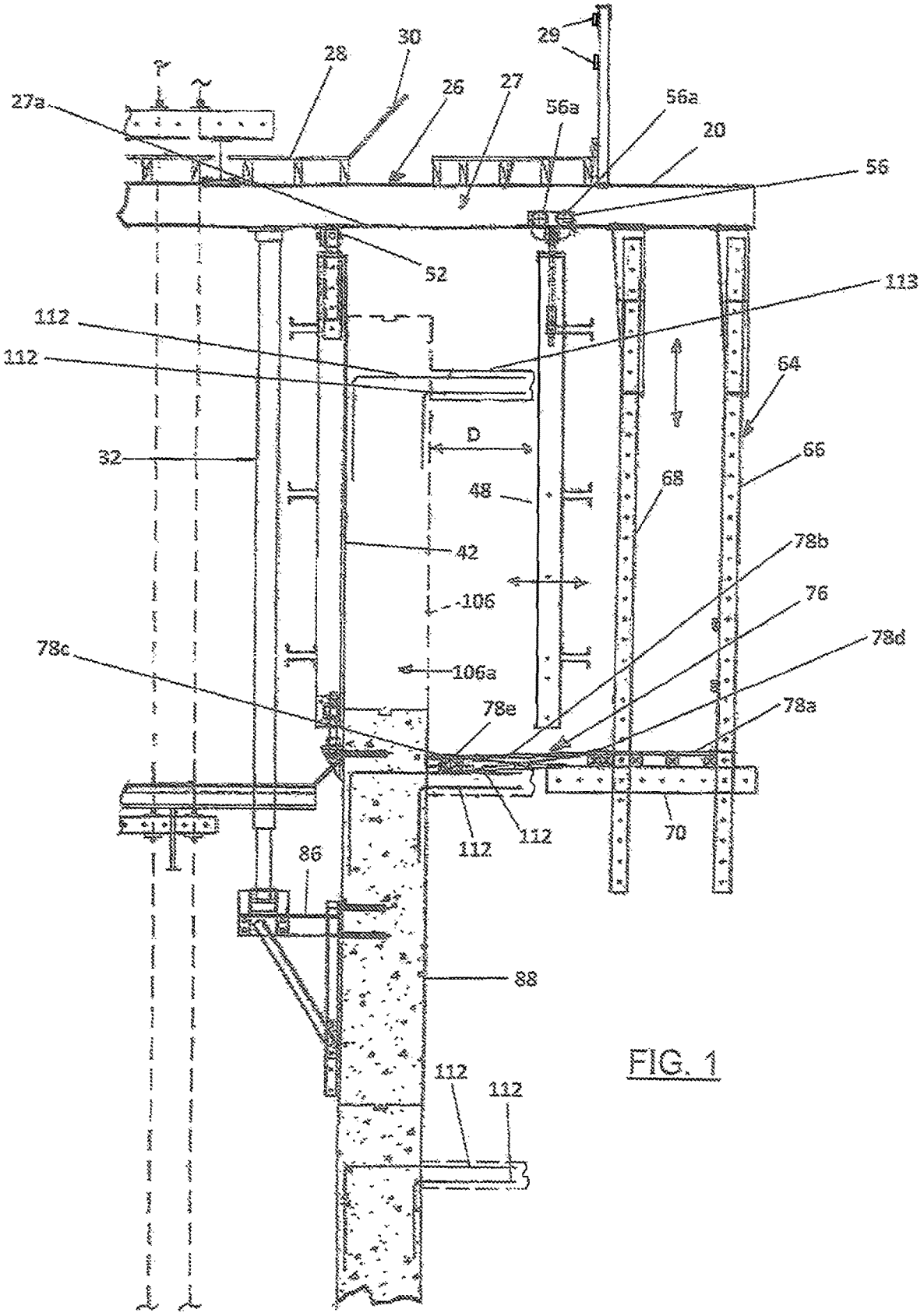
FIG. 1 is a sectional view of a self raising concrete form apparatus of the invention in a state wherein a next course is being prepared for forming.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a self-raising concrete form system 20 that is particularly useful in forming elevator and stair cores in high-rise buildings but can also be useful in other concrete forming operations.

The system includes a frame 26 that has beams 27 supported by a plurality of hydraulic jacks 32. The platform 26 includes an upper platform deck 28 and appropriate railings 29. A cover 30 can be lifted or pivoted giving acces through the platform 28 to the work below.

A first forming wall 42 is fixedly hung from the beams 27 at a connection 52. A second forming wall 48 is hung from the beams 27 using a rolling connection 56. The rolling connection includes wheels **56*a* that roll along a bottom flange 27*a* of the beam 27. The second wall 48 can be rolled toward and away from the first wall 42. A work platform or scaffold 64 is hung from the frame 26. The scaffold includes spaced apart vertical members 66, 68 that support horizontal supports 70. A platform 76 is supported on the supports 70. The platform includes a fixed section 78*a* connected to a first pivoting section 78***b*, by a hinge 78*d*. The first pivoting section 78*b* is connected to a second pivoting section 78*c* by a hinge 78*e*.

The jacks 32 are supported by brackets 86 that are fastened to a previously poured course or level or vertical section 88.

The state or position of the apparatus 20 in FIG. 1 is before a second course 106 is poured onto the previous course 88. Vertical and horizontal reinforcing steel or rebar (not shown) is set within a volume 106*a* that is to be poured with concrete to cast the course 106 (as is known). Additionally, L-shaped rebar 112 is set within the volume 106*a* and extend horizontally for a distance "D" for the purpose of tying the vertical course 106 after being poured with an adjacent to-be-poured concrete floor slab 113. The two pivoting sections 78*b* and 78*c* are pivoted down into a flat horizontal orientation to give workers a working platform to place rebar and prepare the rebar for pouring the course 106. The pivoting sections 78*b* and 78*c* are supported off of the support 70 and/or on the protruding rebar 112.

Figure 2:
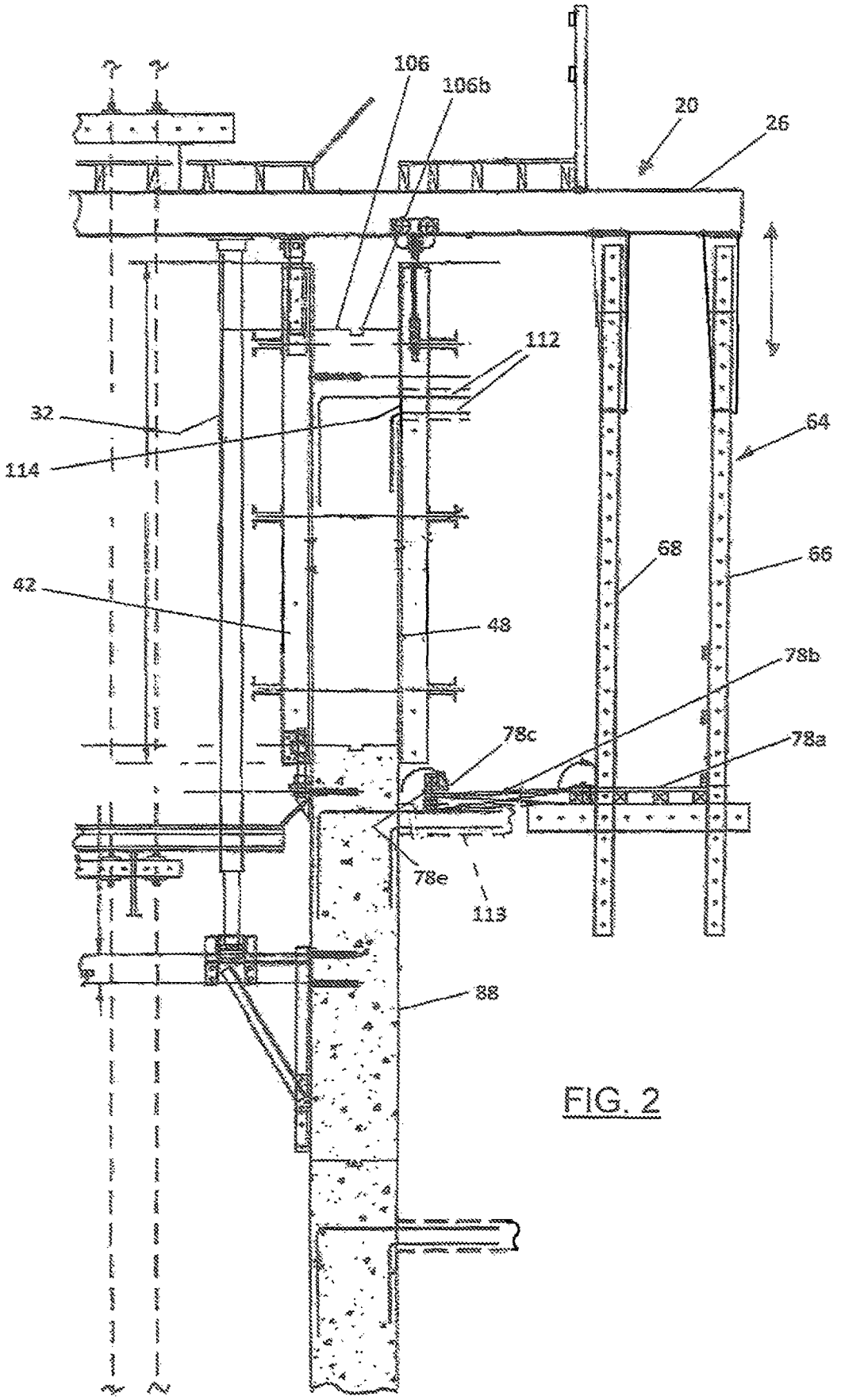
FIG. 2 is a sectional view of the self raising concrete form apparatus of FIG. 1 in a state wherein the course is formed and poured.

FIG. 2 illustrates the second pivoting section 78*c* has been folded back about the hinge 78*e*. The second wall 48 has been rolled via the connection 56 toward the first wall 42 until the distance between the walls 42, 48 corresponds to the desired thickness of the course 106. The course 106 has been poured with a top keyway 106*b* formed by an elongated form block. Typically, rebar (not shown) would extend up through the top of the course 106 to tie the course 106 with the next course to be poured on top of the course 106.

In order to accommodate the rebar 112 extending out of the side of the volume 106*a* between the walls 42, 48, a forming strip 114 is fit into the wall 48. The forming strip 114 can be plywood, a wood plank, expanded metal or some other material. The forming strip 114 is provided with holes for passing the horizontal legs of the rebar 112 therethrough.

Figure 3:
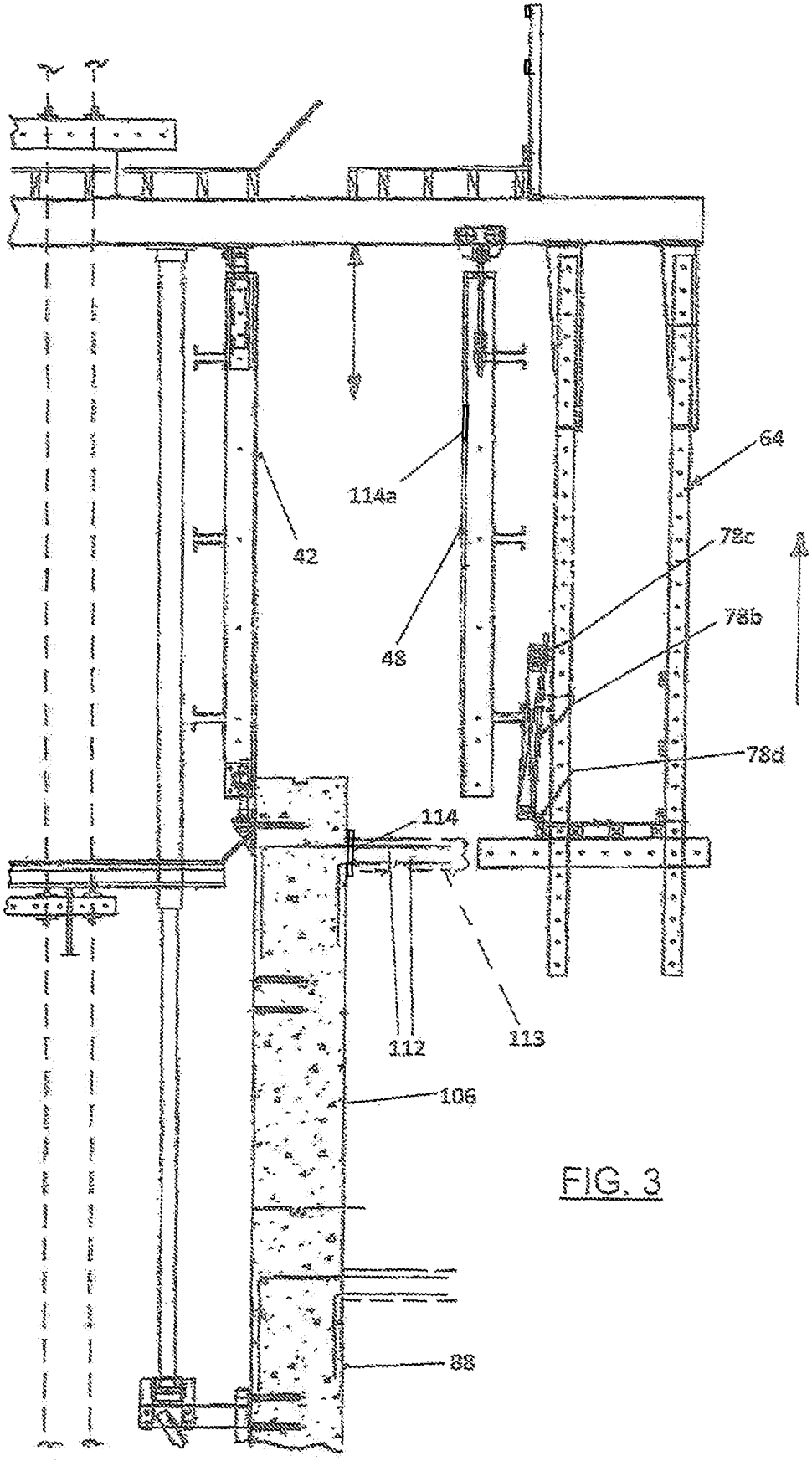
FIG. 3 is a sectional view of the self raising concrete form apparatus of FIG. 1 in a state wherein the apparatus has been raised above the course poured in FIG. 2 to prepare for forming and pouring a course above the course poured in FIG. 2.

FIG. 3 illustrates that the course 106 has been completed and the apparatus 20 has been raised to pour a next course on top of the course 106. In order to raise the apparatus, non-interference with the horizontal legs of the rebar 112 must be accomplished. To this end, the first and second sections 78*b*, 78*c* of the platform have been pivoted back about the hinge 78*d*. Workers can stand on the fixed section 78*a* to accomplish this task. The second wall 48 has been rolled back away from the course 106 by a distance greater than "D." The frame 26 can now be lifted by the jacks 32 and the wall 48 and the scaffold 64, including the platform sections 78*b*, 78*c* will clear the rebar 112 as they vertically rise past the rebar 112.

The forming strip 114 will most likely be somewhat bound to the rebar 112 and it is anticipated that a new forming strip 114*a* will be needed for each new course and the previous forming strip 114 will need to be stripped from the rebar 112 and the previous course before a floor slab is poured around the rebar 112.

Although FIGS. 1-3 illustrates an end view of the apparatus in only the two dimensional plane of the page, it is to be understood that some elongated member extend into the page, such as the walls 42, 48, the strip 114, the sections 88, 106, the platform sections 78*a*, 78*b*, 78*c* and hinges 78*d*, 78*e* and that other elongated members represents not only one member in the plane of the page but a row of like members spaced-apart, in appropriate spacing into the page, such as the beams 27, the corresponding connections 52, 56, the rebar 112, the jacks 32, the vertical members 66, 68, and the supports 70.

A typical construction sequence can be:

Self-lifting concrete form is erected;

A replaceable forming strip 114 is installed in the moving forming wall 48;

Protruding reinforcing steel 112 is installed through the replaceable strip 114;

The moving wall 48 is moved toward the wall 42;

Concrete is poured;

After concrete is sufficiently set the forms are moved, stripped or retracted;

The moving wall 48 is moved back leaving the protruding reinforcing steel 112 and the replaceable forming strip 114 in place;

Primary scaffolding section 78*b*, 78*c* are retracted or hinged back in order to clear the protruding reinforcing steel 112;

Operating personal stand on the fixed section 78*a* while this step is performed;

Once the protruding reinforcing steel 112 is clear of the moving forming wall 48 and all scaffolding, the self-lifting form is operated and lifted to the next pour level;

Once on the next pour level the self-lifting concrete form is anchored and aligned for the next pour;

Another replaceable strip 114*a* is put in place in the moving forming wall 48 and the sequence is repeated; and Prior to pouring the concrete floor slab 113, the replaceable strip 114 that was previously poured against is removed from the protruding reinforcing steel 112.

Figure 4:
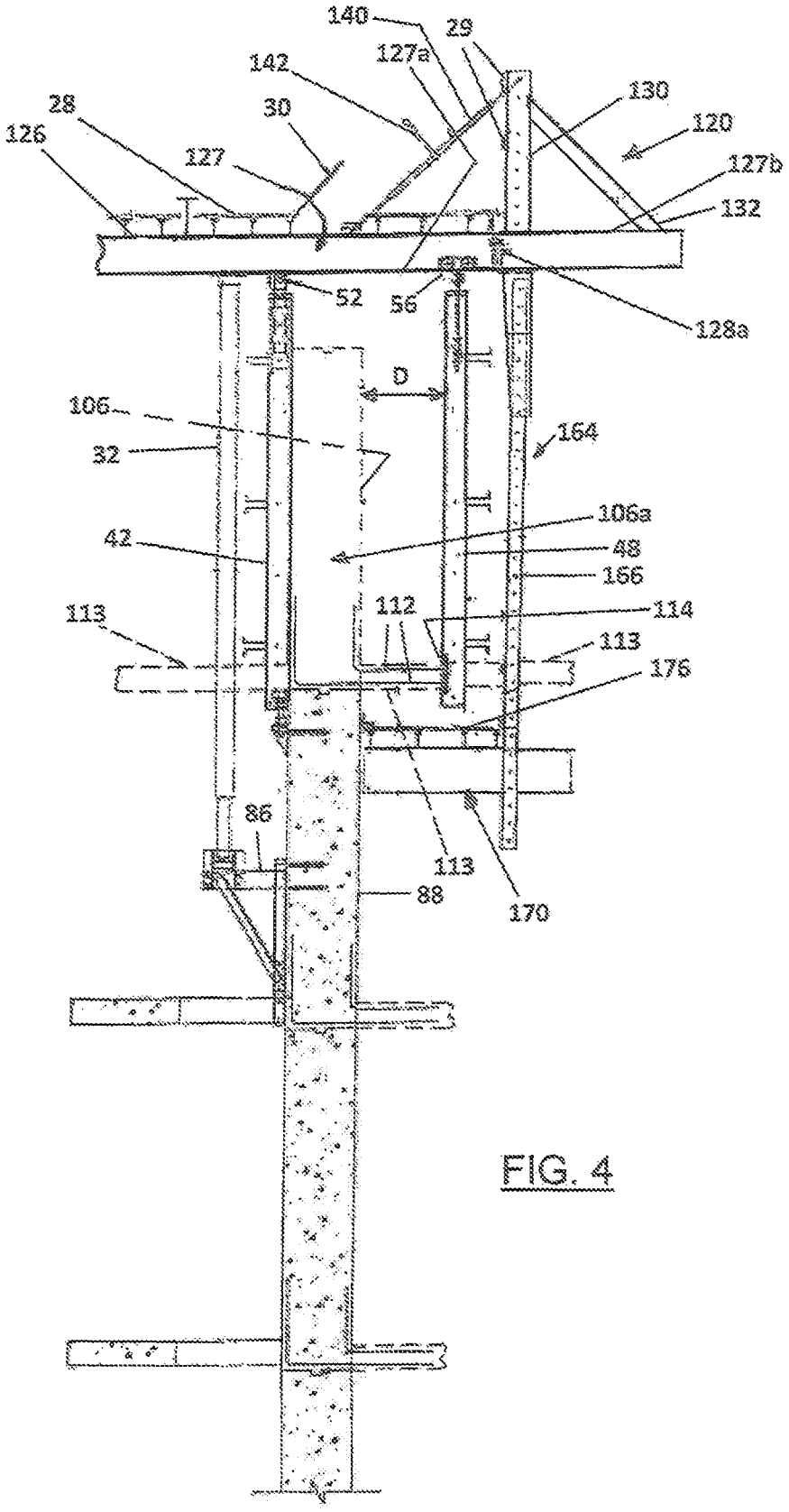
FIG. 4 is a sectional view of an alternate self raising concrete form apparatus of the invention in a state wherein a next course is being prepared for forming.

FIG. 4 illustrates an alternate self-raising concrete form system 120. Many of the components hare identical to those incorporated into the system 20 of FIGS. 1-3 and like component are indicated by the same reference number.

The system includes a frame 126 that has beams 127 supported by a plurality of hydraulic jacks 32. The first forming wall 42 is fixedly hung from the beams 127 at the connection 52. The second forming wall 48 is hung from the beams 127 using the rolling connection 56 which rolls on the lower flange 127*a* of the beams 127. The second wall 48 can be rolled toward and away from the first wall 42.

Figure 6:
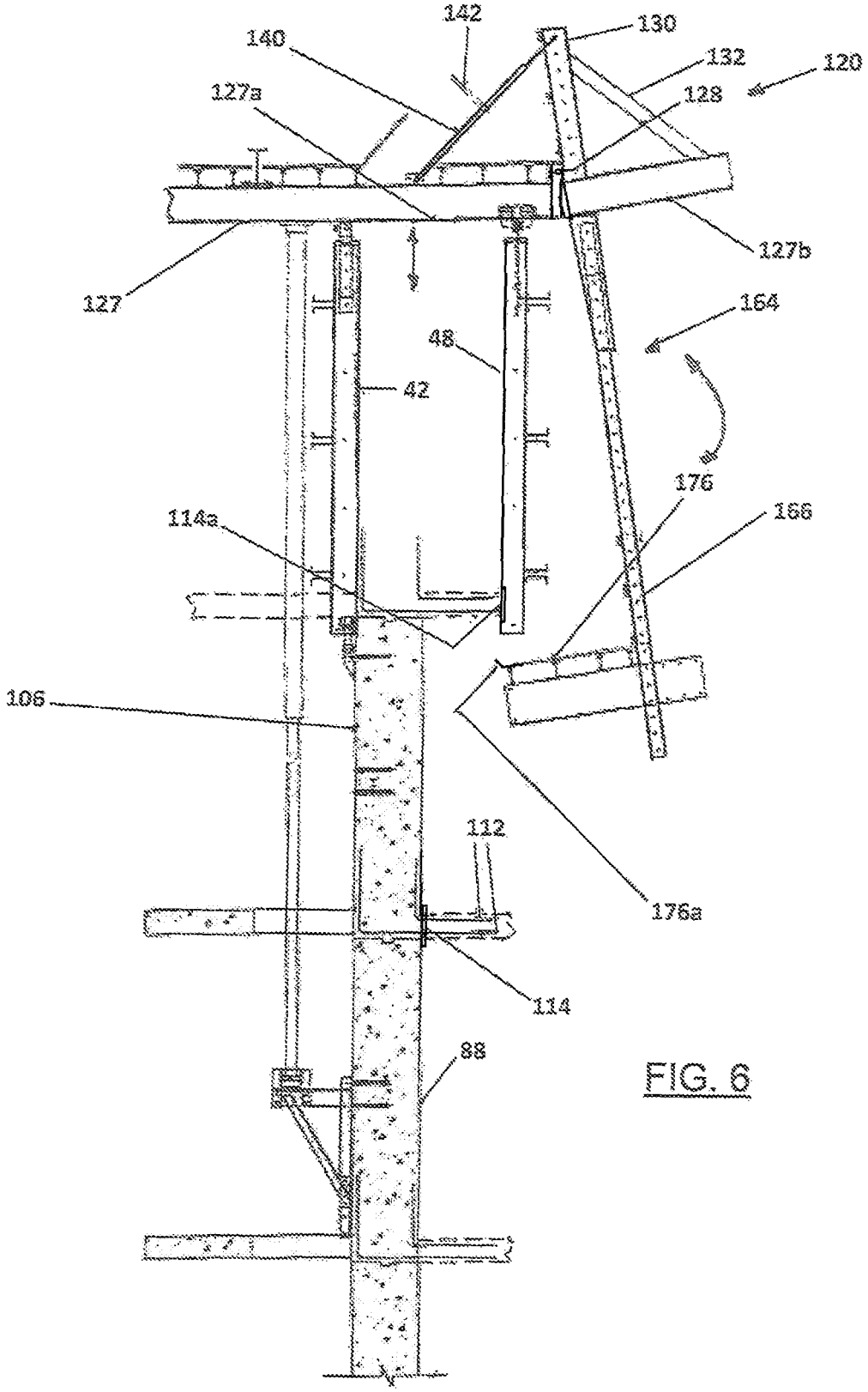
FIG. 6 is a sectional view of the self raising concrete form apparatus of FIG. 4 in a state wherein the apparatus has been raised above the course poured in FIG. 5 to prepare for forming and pouring a course above the course poured in FIG. 5.

A work platform or scaffold 164 is hung from the frame 126. Particularly, the a hinged extension 127*b* is hinged to the beams 127 at a hinge 128. A fastener 128*a* below the hinge, with the hinge secures the beams 127, 127*b* together for non rotation about the hinge. A post 130 is fixed to a top side of the extension 127*b*, and a knee brace 132 connects the post to the extension 127*b*. A jack, such as a ratchet jack 140, is fixed at opposite ends to the post and the beam 127, such that by shortening the length of the ratchet jack by operation of the jack handle 142, the post 130 and the extension 127*b* can pivot about the hinge 128 (as shown in FIG. 6). The scaffold includes vertical members 166 fixed to the extension 127*b* that support horizontal supports 170. A platform 176 is supported on the supports 170.

The jacks 32 are supported by brackets 86 that are fastened to a previously poured course or level or vertical section 88.

The state or position of the apparatus 120 in FIG. 4 is before a second course 106 is poured onto the previous course 88. Vertical and horizontal reinforcing steel or rebar (not shown) is set within a volume 106*a* that is to be poured with concrete to cast the course 106 (as is known). Additionally, L-shaped rebar 112 is set within the volume 106*a* and extend horizontally for a distance "D" for the purpose of tying the vertical course 106 after being poured, with an adjacent to-be-poured concrete floor slab 113.

Figure 5:
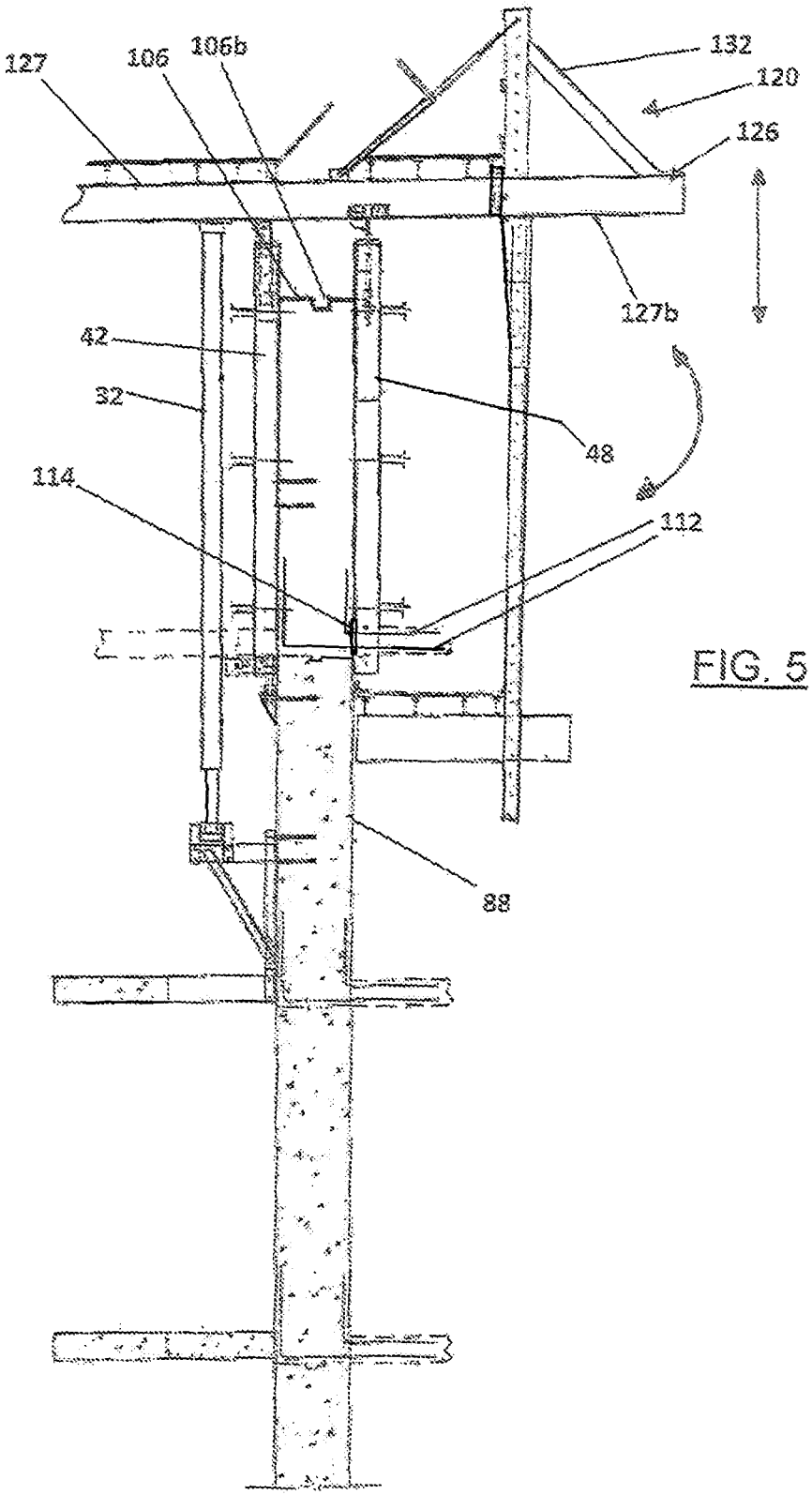
FIG. 5 is a sectional view of the self raising concrete form apparatus of FIG. 4 in a state wherein the course is formed and poured.

FIG. 5 illustrates the second wall 48 has been rolled via the connection 56 toward the first wall 42 until the distance between the walls 42, 48 corresponds to the desired thickness of the course 106. The course 106 has been poured with a top keyway 106*b* formed by an elongated form block. Typically, rebar (not shown) would extend up through the top of the course 106 to tie the course 106 with the next course to be poured on top of the course 106.

In order to accommodate the rebar 112 extending out of the side of the volume 106*a* between the walls 42, 48, the forming strip 114 is fit into the wall 48.

FIG. 6 illustrates that the course 106 has been completed and the apparatus 20 has been raised to pour a next course on top of the course 106. In order to raise the apparatus, non-interference with the extending horizontal legs of the rebar 112 must be accomplished. The fastener 128*a* has been removed. The ratchet jack 140 has been actuated to shorten the effective length of the ratchet jack 140 to pivot the post 130, the extension 127*b* and the vertical members 166 counterclockwise in FIG. 6. The platform 176 swings to the right to a position of vertical non-interference with the rebar 112. A debris catch or lip 176*a* is provided on the platform to prevent debris on the platform from falling down off the platform once the platform is tilted. The second wall 48 has been rolled back away from the course 106 by a distance greater than "D." The frame 26 can now be lifted by the jacks 32 and the wall 48 and the scaffold 164, including the platform 176 will clear the rebar 112 as they vertically rise past the rebar 112.

Although FIGS. 4-6 illustrates an end view of the apparatus in only the two dimensional plane of the page, it is to be understood that some elongated members extend into the page, such as the walls 42, 48, the strip 114, the poured concrete sections 88, 106, and the platform 176 and that other members represents not only one member in the plane of the page but a row of like members spaced-apart, in appropriate spacing into the page, such as the beams 127, the corresponding connections 52, 56, the rebar 112, the jacks 32, the vertical members 166, the supports 170, the extensions 127*b*, the hinges 128 and fasteners 128*a*, the posts 130, the knee braces 132 and the jacks 140.

A typical construction sequence can be:

Self-lifting concrete form system 120 is erected;

A replaceable forming strip 114 is installed in the moving forming wall 48;

Protruding reinforcing steel 112 is installed through the replaceable strip 114;

The moving forming wall 48 is moved toward the wall 42;

Concrete is poured;

After concrete is sufficiently set the forms are moved, stripped or retracted;

The moving wall 48 is moved back leaving the protruding reinforcing steel 112 and the replaceable forming strip 114 in place;

Platform 176 is rotated away from the poured wall using the jacks 140 in order to clear the protruding reinforcing steel 112;

Once the protruding reinforcing steel 112 is clear of the moving forming wall 48 and all the platform 176, the self-lifting form is operated and lifted to the next pour level;

Once on the next pour level the self-lifting concrete form is anchored and aligned for the next pour;

Another replaceable strip 114*a* is put in place in the moving forming wall 48 and the sequence is repeated; and Prior to pouring the concrete floor slab 113, the replaceable strip 114 that was previously poured against is removed from the protruding reinforcing steel 112.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A forming system, comprising:

a frame;

two forming walls that are movable to a distance from each other to define a thickness of a vertical void to be filled with concrete to form a first vertical wall course, one forming wall of the two forming walls is supported by the frame such that the wall can be translated toward or away from the respective other forming wall of the two forming walls, the respective other forming wall also supported by the frame, the frame can be raised to raise the two forming walls to be positioned to pour a second vertical course on top of the first vertical wall course, wherein the translation of the one forming wall allows for the pouring of the first vertical wall course having a plurality of horizontally extending rebar, that extends outside of the first vertical wall course to tie in a floor slab to the first vertical wall course, and for the vertical raising of the two forming walls to pour the second vertical wall course on the first vertical wall course without interference of the vertical movement of the one forming wall with the plurality of horizontally extending rebar, wherein the one forming wall is movable horizontally away from the respective other forming wall by a distance sufficient to clear the plurality of horizontally extending rebar;

wherein the one forming wall has a plurality of spaced-apart openings, each opening sized for receiving a horizontally extending rebar, allowing the plurality of horizontally extending rebar to pass through the one forming wall outside of the vertical void.

2. The forming system according to claim 1, further comprising a worker's platform supported by the frame and vertically movable by raising the frame, the worker's platform located below the one forming wall on a side of the one forming wall opposite the respective other forming wall, wherein the worker's platform is retractable to also clear the plurality of horizontally extending rebar when moved vertically after forming the first vertical wall course to form the second vertical wall course.

3. The forming system according to claim 2, wherein the worker's platform is hung pivotally from the frame and is pivoted away from the one forming wall to clear the plurality of horizontally extending rebar.

4. The forming system according to claim 2, wherein the worker's platform is hung from the frame and is folded back to clear the plurality of horizontally extending rebar.

5. The forming system according to claim 1, wherein a forming strip is positioned onto the one forming wall to provide the spaced-apart openings for the plurality of horizontally extending rebar and forms part of the forming surface of the one forming wall.

6. The forming system according to claim 5, wherein when the one forming wall is moved away from the respective other forming wall after the poured concrete between the two forming walls has sufficiently set or cured, the forming strip detaches from the one forming wall and is thereafter stripped off of the first vertical wall course and from around the plurality of horizontally extending rebar.

7. The forming system according to claim 1, wherein the two forming walls are hung from the frame and the one forming wall is hung with a rolling connection to be translated toward or away from the respective other forming wall.

8. The forming system according to claim 2, wherein the worker's platform is hung pivotally from the frame and is pivoted away from the one forming wall to clear the horizontally extending rebar; and a forming strip is positioned onto the one forming wall to provide the spaced-apart openings for the plurality of horizontally extending rebar and forms part of the forming surface of the one forming wall.

9. The forming system according to claim 8, wherein when the one forming wall is moved away from the respective other forming wall after the poured concrete between the two forming walls has sufficiently set or cured, the forming strip detaches from the one forming wall and is thereafter stripped off of the first vertical wall course and from around the plurality of horizontally extending rebar.

10. The forming system according to claim 9, wherein the two forming walls are hung from the frame and the one forming wall is hung with a rolling connection to be translated toward or away from the respective other forming wall.

11. The forming system according to claim 2, wherein the worker's platform is hung from the frame and is folded back to clear the plurality of horizontally extending rebar;

and wherein a forming strip is positioned onto the one forming wall to provide the spaced-apart openings for the plurality of horizontally extending rebar and forms part of the forming surface of the one forming wall.

12. The forming system according to claim 11, wherein when the one forming wall is moved away from the respective other forming wall after the poured concrete between the two forming walls has sufficiently set or cured, the forming strip detaches from the one forming wall and is thereafter stripped off of the first vertical wall course and from around the plurality of horizontally extending rebar.

13. The forming system according to claim 12, wherein the two forming walls are hung from the frame and the one forming wall is hung with a rolling connection to be translated toward or away from the respective other forming wall.

* * * * *